US008044806B2

(12) United States Patent
Sayegh

(10) Patent No.: US 8,044,806 B2
(45) **Date of Patent: *Oct. 25, 2011**

(54) SECURITY TAG WITH ENGAGING ELEMENT

(76) Inventor: Adel O. Sayegh, Rancho Cucamonga, CA (US)

( * ) Notice: Subject to any disclaimer, the term of this patent is extended or adjusted under 35 U.S.C. 154(b) by 629 days.

This patent is subject to a terminal disclaimer.

(21) Appl. No.: 11/875,802

(22) Filed: Oct. 19, 2007

(65) Prior Publication Data

US 2008/0156047 A1 Jul. 3, 2008

Related U.S. Application Data

(60) Provisional application No. 60/862,196, filed on Oct. 19, 2006.

(51) Int. Cl.
*G08B 13/14* (2006.01)

(52) U.S. Cl. ..... 340/572.9; 70/57.1; 24/115 K; 24/136 R; 292/307 A; 292/307 B; 292/307 R; 292/315

(58) Field of Classification Search ..... 340/572.9, 340/500, 540, 568.1, 572.1, 572.8
See application file for complete search history.

(56) References Cited

U.S. PATENT DOCUMENTS

| | | | | |
|---|---|---|---|---|
| 3,858,280 | A | 1/1975 | Martens | |
| 3,911,534 | A | 10/1975 | Martens et al. | |
| 3,932,918 | A | 1/1976 | Paskert | |
| 3,942,829 | A | 3/1976 | Humble et al. | |
| 3,974,581 | A | 8/1976 | Martens et al. | |
| 4,221,025 | A | 9/1980 | Martens et al. | |
| 4,588,218 | A | 5/1986 | Guiler et al. | |
| 5,610,587 | A | 3/1997 | Fujiuchi et al. | |
| 5,722,266 | A | 3/1998 | Yeager et al. | |
| 5,794,464 | A | 8/1998 | Yeager et al. | |
| 6,052,876 | A | 4/2000 | Hogan et al. | |
| 6,092,401 | A | 7/2000 | Sankey et al. | |
| 6,535,130 | B2 | 3/2003 | Nguyen et al. | |
| D492,215 | S | 6/2004 | Lu | |
| 6,933,847 | B2 | 8/2005 | Feibelman | |
| 7,062,823 | B2 | 6/2006 | Copen et al. | |
| 7,129,841 | B2 | 10/2006 | Feibelman | |
| 7,227,467 | B2 | 6/2007 | Feibelman | |
| 2005/0128089 | A1 * | 6/2005 | Feibelman | 340/572.9 |
| 2006/0049646 | A1 * | 3/2006 | Lima Castro | 292/318 |
| 2006/0145873 | A1 | 7/2006 | Feibelman et al. | |

FOREIGN PATENT DOCUMENTS

WO WO2006040693 4/2006

* cited by examiner

*Primary Examiner* — Brian Zimmerman
*Assistant Examiner* — Sara Samson
(74) *Attorney, Agent, or Firm* — Milord A. Keshishian

(57) ABSTRACT

A theft deterrent tag is provided that has an engaging element which forms a loop for attaching to an article or object to be monitored thereby. A second engaging element can also be provided to secure an article or object.

15 Claims, 5 Drawing Sheets

SECURITY TAG WITH ENGAGING ELEMENT

CROSS-REFERENCE TO RELATED APPLICATIONS

This application claims priority from U.S. provisional patent application Ser. No. 60/862,196 filed on Oct. 19, 2006, the contents of which are incorporated herein by reference.

FIELD OF THE INVENTION

The invention relates to theft deterrent and security tags in general, and in particular to a disposable tag body containing an adjustable engaging element and having a an electronic marker comprised of, for purposes of illustration, either an electronic article surveillance (EAS) or for RFID device, or a combination of both.

BACKGROUND OF THE INVENTION

Various types of theft deterrent and article monitoring devices are known in the art. Electronic article surveillance (EAS) systems are known having the common feature of employing a marker or tag which is affixed to an article to be protected against theft, such as merchandise in a retail store. When a legitimate purchase of the article is made, the marker can either be removed from the article, or converted from an activated state to a deactivated state. Such systems employ a detection arrangement, commonly placed at all exits of a retail store, and if an activated marker passes through the detection system, it is discovered by the detection system and an alarm is triggered. In addition, other tags are known that utilize ink vials that break and release a permanent staining fluid onto the article if the tag is not removed by an authorized individual.

Existing devices do not address the need for an integrated security tag that is difficult to defeat and easy to use. In addition, the existing devices fail to provide a theft deterrent tag assembly that allows easy attachment of the lanyard to the tag. Therefore, there remains a long standing and continuing need for an advance in existing security devices and theft deterrent tags that makes the tags more difficult to defeat, simpler in both design and use, more economical and efficient in their construction and use, and provides a more secure engagement of the article.

SUMMARY OF PREFERRED EMBODIMENT(S)

Accordingly, it is a general object of the present invention to overcome the disadvantages of existing devices.

Therefore, it is a primary objective of the invention to provide a security tag that is more difficult to defeat.

It is another objective of the invention to provide a cost-efficient security tag in use and manufacture.

It is a further objective of the invention to provide a security tag that may be disposable.

It is a yet another objective of the invention to provide a security tag that may easily be attached to an article.

In keeping with the principles of a preferred embodiment, a unique security tag is disclosed wherein a lanyard passes through or around an article to be monitored, and is securely maintained within the tag body in an adjustable manner. The attaching mechanism is maintained within the tag body and autonomously engages the lanyard in a secure manner without the need for insertion of any tools into the tag body. A plurality of lanyards can extend from the tag body and a plurality of attaching mechanisms can be provided within the tag body to accommodate the lanyards.

Such stated objects and advantages of the preferred embodiment or embodiments are only examples and should not be construed as limiting the present invention. These and other objects, features, aspects, and advantages of the invention herein will become more apparent from the following detailed description of the embodiments of the invention when taken in conjunction with the accompanying drawings and the claims that follow.

BRIEF DESCRIPTION OF THE DRAWINGS

It is to be understood that the drawings are to be used for the purposes of illustration only and not as a definition of the limits of the preferred embodiment. In the drawings, wherein similar reference characters denote similar elements throughout the several views.

DETAILED DESCRIPTION OF THE INVENTION

Figure 1:
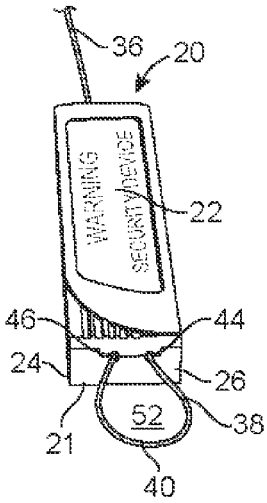
FIG. 1 is a front end perspective view of the tag of the instant invention in an assembled state.
Figure 2:
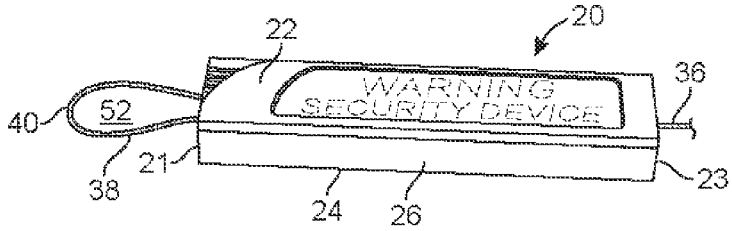
FIG. 2 is a side elevational view of the tag of the instant invention in an assembled state.
Figure 3:
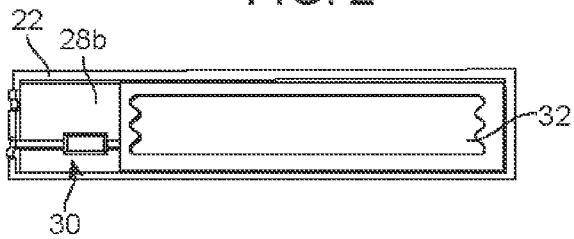
FIG. 3 is a plan view of the interior of the inner surface of first section of the tag body.
Figure 4:
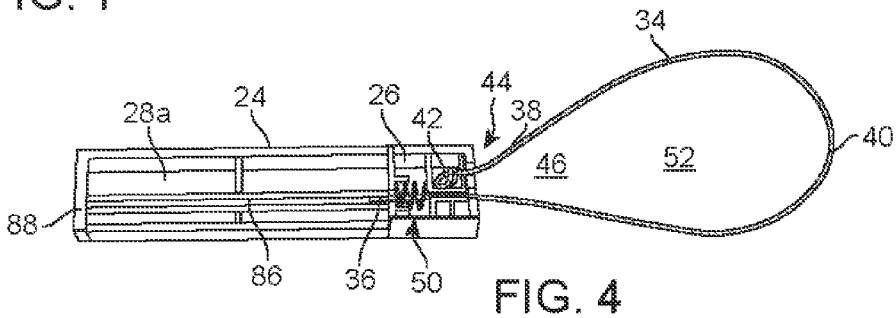
FIG. 4 is a side perspective partial cut-away view of the interior of the second section of the tag body.
Figure 5:
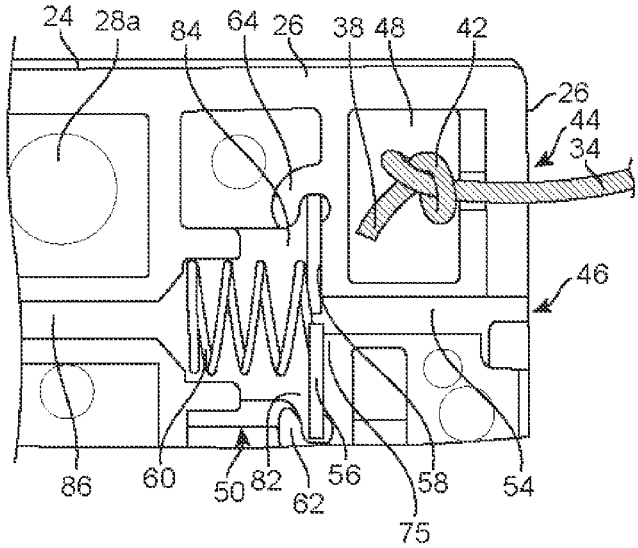
FIG. 5 is an enlarged partial cut-away plan view of the interior of the second section of the tag body focusing on the attaching mechanism in an unengaged state.
Figure 6:
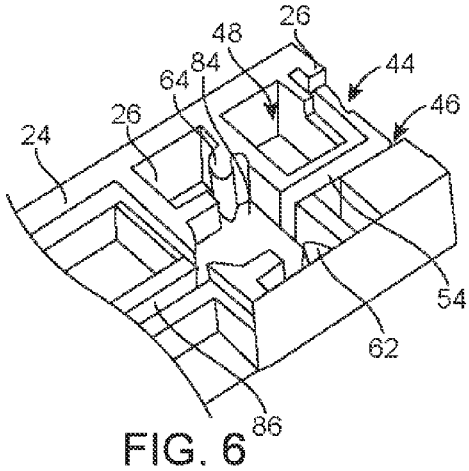
FIG. 6 is an enlarged partial cut-away perspective view of the interior of the second section of the tag body without the attaching mechanism or engaging element.
Figure 7:
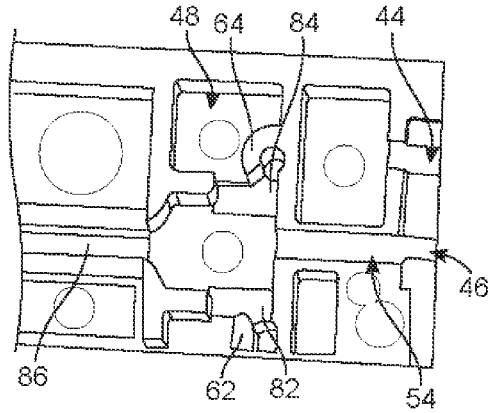
FIG. 7 is an enlarged partial cut-away plan view of the interior of the second section of the tag body without the attaching mechanism or engaging element.
Figure 8:
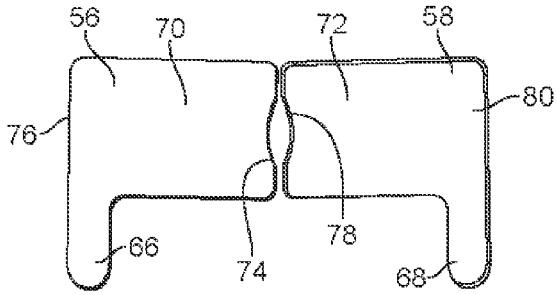
FIG. 8 is a plan view of first and second fastening members that have been removed from the first and second retaining members.
Figure 9:
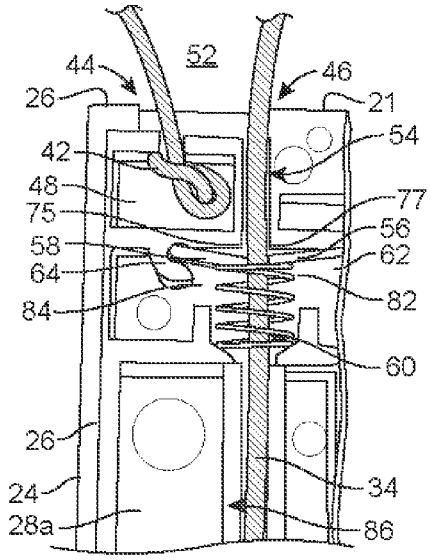
FIG. 9 is an enlarged partial cut-away plan view of the interior of the second section of the tag body focusing on the attaching mechanism securing the engaging element.
Figure 10:
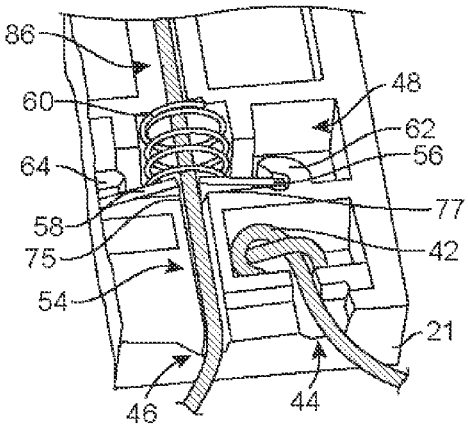
FIG. 10 is an enlarged partial cut-away front perspective view of the interior of the second section of the tag body focusing on the attaching mechanism securing the engaging element. The first section is not illustrated.

Referring now to FIGS. 1 through 5, a tag body 20 is illustrated having a first section 22 and a second section 24. First and second sections 22 and 24 are preferably made of a hard or rigid material and are adapted to attach to one another and form a front end 21 and a rear end 23. A usable rigid or hard material might be a hard plastic such as, for purposes of illustration but not limitation, an injection molded ABS plastic or like material.

Second section 24 has a peripheral wall 26 extending inwardly from a second inner surface 28*a* of second section 24 and securely engaging first section 22. If a plastic material is used for the body of tag 20, the mating of peripheral wall 26 to first section 22 can be accomplished via an ultrasonic weld or like joining mechanism. However, it is to be understood that other joining methods known in the art, such as adhesives for example, may also be used. A first inner surface 28*b* of first section 22 and second inner surface 28*a* of second section 24 oppose one another and create a cavity 30 within which a marker 32 is enclosed. In one preferred embodiment, marker 32 may be attached to first inner surface 28*b* with an adhesive.

Marker 32 may be an Electronic Article Surveillance ("EAS") device or any means known in the art for monitoring an article to which it is attached. Conventional EAS devices or tags include a resonator that, when activated, causes an alarm to sound when the EAS tag is brought within operative proximity of detection apparatus (which is typically located at the exit of a store). Marker 32 may also be a radio-frequency ("RFID") device. RFID is a generic term for technologies that use radio waves to automatically identify objects such as tagged products. There are several conventional methods of identifying objects using RFID, the most common of which is to store a serial number (and other information if desired) that identifies the object on a microchip that is attached to an antenna. The chip and the antenna, together with any supporting substrate, herein are called an RFID device or an RFID tag. The antenna enables the chip to transmit the identification information to a reader. The reader converts the radio waves from the RFID device into a form that can then be utilized by a computer and read by a user. Marker 32 may also be any transponder or a combination of both an EAS and RFID device, and can also incorporate any later developed technology to track inventory or servile articles. Marker 32 is adapted to operate along the lines of a frequency modulated (FM) radio and also amplitude modulated (AM) radio signals.

An engaging element 34 has a first end 36 and a second end 38, at points distal to one another, and a middle region 40 therebetween. Engaging element 34 may be a lanyard preferably formed of stainless steel cable or like material that is flexible yet strong. A catch 42 is formed on second end 38 and is larger in diameter than the width of the engaging element 34. Catch 42 may be formed by creating a knot on second end 38 or catch 42 may be formed by crimping an anchor like device or metal element onto second end 38 or by soldering thereon. In addition, catch 42 may also preferably be formed by crimp splices.

A first aperture 44 and a second aperture 46 are defined through tag body 20. In one preferred embodiment, first 44 and second 46 apertures are defined through peripheral wall 26 proximal to front end 21. However, it is to be understood that apertures 44 and 46 may be formed through any portion of the tag body 20 without departing from the scope of the invention. First end 36 is fed through first aperture 44 from within tag body 20 and emanates from front end 21. However, as a result of the larger diameter of catch 42, it cannot pass through first aperture 44 and is securely maintained within attaching tag body 20. In a preferred embodiment, a first chamber 48 is defined within tag body 20 that is proximal to first aperture 44, such that catch 42 is maintained within first chamber 48 in a secure manner.

First end 36 of engaging element 34 is passed through an article to be monitored and first end 36 is inserted into second aperture 46. An attaching mechanism 50 is located within tag body 20 proximal to second aperture 46 and securely receives and maintains first end 36 therein. In such a state, the article to be monitored is maintained within a first loop 52 formed by engaging element 34. The article to be monitored may be of a wide range of sizes and the initial starting length of engaging element 34 may be of various predetermined lengths in order to accommodate the varying articles. However, despite the various predetermined starting lengths of engaging element 34, the size of first loop 52 may be adjusted after the insertion of first end 36 as a result of the dynamic attaching mechanism 50. For purposes of illustration, but not limitation, the article may be a baseball bat where engaging element 34 passes around the handle region of the bat and the engaging element 34 may be adjusted via attaching mechanism 50 such that first loop 52 tightens around the handle and it is maintained in a firm and snug manner by element 34.

Now also referring to FIGS. 6 through 10, a first path 54 extends inwardly from first aperture 44 and is defined by tag body 20. First path 54 may be defined by a pair of parallel walls extending inwardly from second inner surface 28*a* and enclosed by first inner surface 28*b* and second inner surface 28*a*. Attaching mechanism 50 is comprised of at least a first fastening member 56, but in a preferred embodiment it comprises a second fastening member 58, and a biasing member 60. Although in the preferred embodiment a coiled spring is illustrated as the biasing member 60, other resilient devices known in the art may be substituted therefor. A first retaining member 62 and a second retaining member 64 receive and movable maintain first fastening member 56 and second fastening member 58, respectively. First and second fastening members 56 and 58 have a first and second protrusion 66 and 68 respectively and first and second protrusions 66 and 68 serve as a base around which fastening member 56 and 58 rotate when held within first and second retaining members 62 and 64, respectively. First and second fastening members 56 and 58 have a first barrier 70 and a second barrier 72, respectively.

First barrier 70 has a first forward region 74 and a first rearward region 76 distal thereto. First forward region 74 may be substantially concave to allow passage of first end 36 there through, but it is sufficiently sized to prevent the withdrawal of engaging element 34. First protrusion 66 extends substantially perpendicular to the axis formed between first forward region 74 and first rearward region 76 and is located proximal to the first rearward region 76. Second barrier 72 has a second forward region 78 and a second rearward region 80 distal thereto. Second forward region 78 may be substantially concave to allow passage of first end 36 there through, but it is sufficiently sized to prevent the withdrawal of engaging element 34. Second protrusion 68 extends substantially perpendicular to the axis formed between second forward region 78 and second rearward region 80 and is located proximal to the second rearward region 80.

First retaining member 62 and second retaining member 64, in one preferred embodiment, are substantially "c" or "u" shaped, where the open region of each "c" or "u" faces the other as in a mirror image. In addition, a first wall 82 and a second wall structure 84 extend in height partially into the open region of each "c" or "u" structure such that first and second protrusions 66 and 68 are maintained within the circular region and the first and second barriers 70 and 72 rest upon first and second wall structures 82 and 84, respectively, and each barrier 70 and 72 is able to pivot within the opening of each "c" or "u" shape. First and second barriers 70 and 72 are arranged such that their first and second forward regions contact one another or are substantially proximal to one another when engaging element 34 is not engaged and the point of contact between the two is substantially aligned with first path 54.

Biasing member 60 is located on a side of first and second barriers 70 and 72 that is on the opposite side of first path 54, such that biasing member 60 forces first and second barriers 70 and 72 toward first path 54. When first end 36 is inserted through path 54, it contacts first and second barriers 70 and 72 at the first and second forward regions 74 and 78 respectively and forces biasing member 60 backwards such that first end 36 travels there between. When first end 36 is at rest, biasing member 60 forces first and second barriers 70 and 72 back toward first path 74 such that engaging element 34 is securely maintained between first and second forward regions 74 and 78 and cannot be withdrawn from within tag body 20. However, if a user wishes to tighten first loop 52, engaging element 34 may further be inserted into path 54 and travels between first and second barriers 70 and 72. When a sufficient grip is formed lanyard 34, first and second forward regions 74 and 78 prevent the withdrawal of engaging element 34.

In an alternate preferred embodiment, either the first fastening member 56 or the second fastening member 58 may be used without the need for the other. In such an arrangement, for example, the first forward region 74 and a first edge 75 defined by a wall on path 54 can maintain engaging element 34 there between without the need for the second fastening member 58. Alternatively, second fastening member 58 and a second edge 77 would perform a similar function without requiring the first fastening member 56.

A second path 86 is defined past biasing member 60 and receives first end 36 of engaging element 34 therein. First end 36 travels through second path 86 and out of tag body 20 via a third aperture 88 located distal to second aperture 46 and defined by tag body 20. The excess engaging element 34 that extends from third aperture 88 may either be left there or cut by a user as desired. It is to be understood that a plurality of attaching mechanisms 50 may be aligned to further strengthen the grip on engaging element 34.

Figure 11:
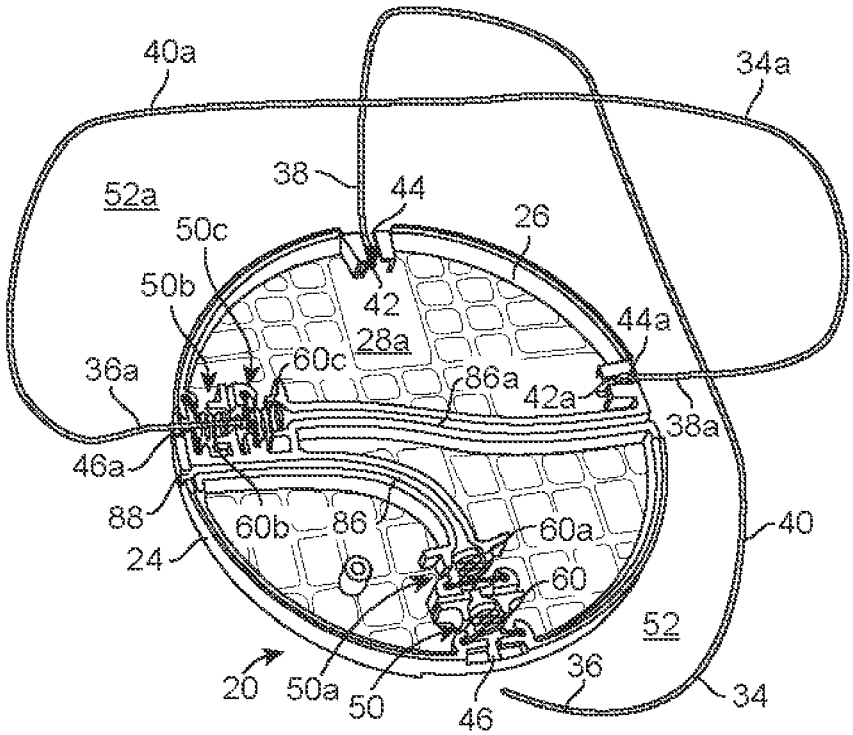
FIG. 11 is a partial cut-away perspective view of the alternate preferred embodiment of the interior of the second section of the tag body illustrating multiple lanyard, alternate placement of the apertures, and multiple attaching mechanisms.
Figure 12:
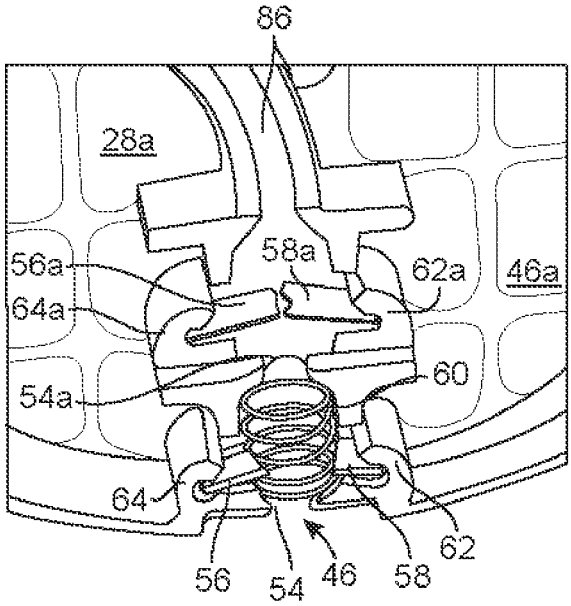
FIG. 12 is an enlarged partial cut-away top perspective view of the interior of the second section of alternate preferred embodiment of the tag body.
Figure 13:
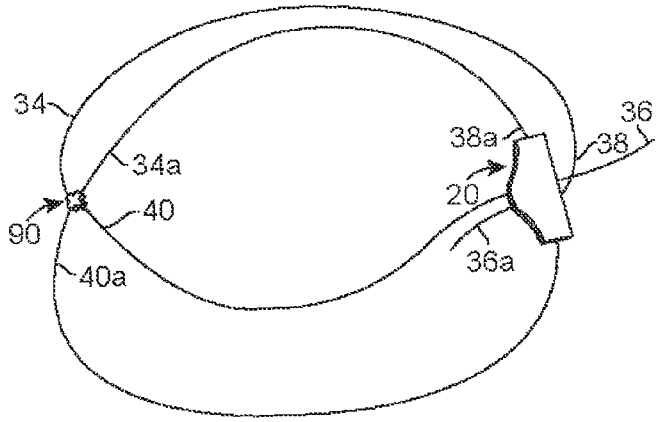
FIG. 13 is a perspective view of an alternate preferred embodiment illustrating the tag while not attached to an article.
Figure 14:
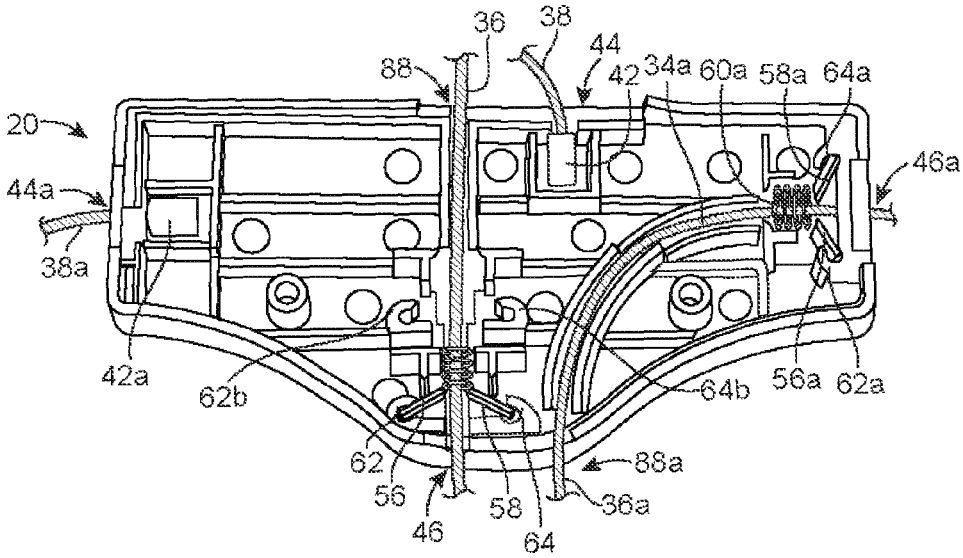
FIG. 14 is a cut-away perspective view of the interior of the tag body of an alternate preferred embodiment.
Figure 15:
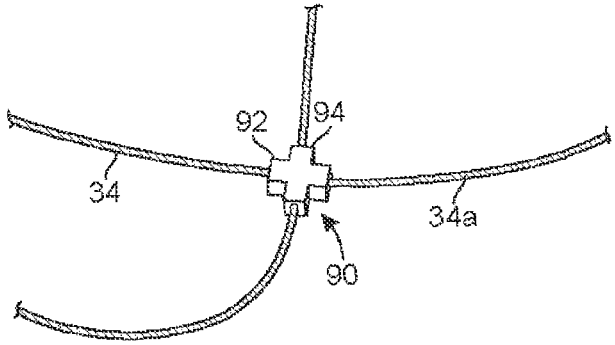
FIG. 15 is a perspective closer view of a holder of an alternate preferred embodiment.
Figure 16:
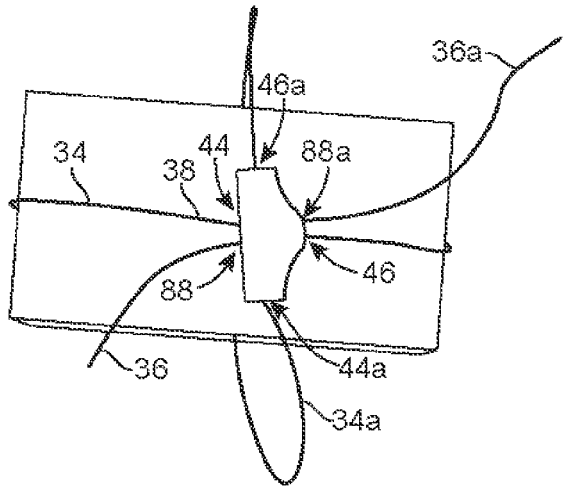
FIG. 16 is a perspective view of a first stage of attachment to an article to be monitored wherein the engaging elements have not been fully tightened.
Figure 17:
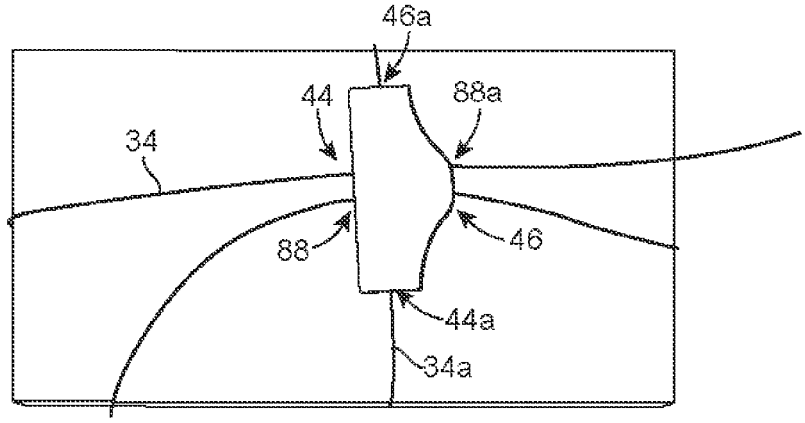
FIG. 17 is a perspective view of a final stage of attachment to an article to be monitored wherein the engaging elements have been fully tightened to engage the article.
Figure 18:
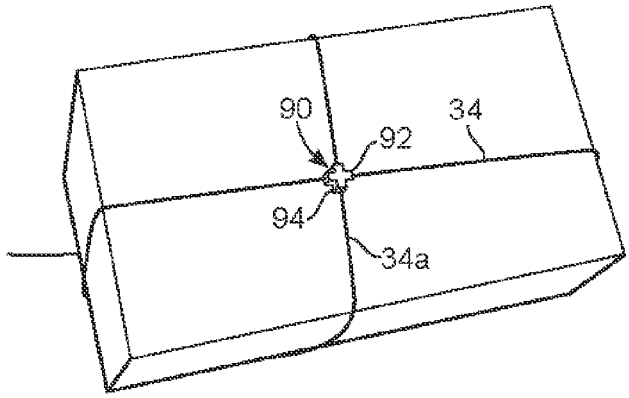
FIG. 18 is a perspective view of the holder as the tag is attached to the article.

Now also referring specifically to FIGS. 11 and 12, a tag body 20 is shown having an alternate preferred embodiment of having two engaging elements 34. This arrangement can be used to enclose boxes either in a retail store or during shipping to ensure that the contents of the boxes have not been tampered with. In this embodiment, all parts which are the same as or similar to corresponding parts in the embodiment of FIGS. 1 through 10 are noted with the same reference numerals, but followed by a letter (i.e. a through c). As illustrated, the tag body has four sets of attaching mechanisms 50, 50*a*, 50*b*, and 50*c*. However, it is to be understood that additional attaching mechanisms may be provided, preferably in alignment, to increase the grip on lanyard 34. In this alternate preferred embodiment, two engaging elements 34 and 34*a* (for example, but not limitation, a lanyard, cable, steel cable, straps, or the like) extend from first apertures 44 and 44*a* respectively and are received within second apertures 46 and 46*a* respectively such that two first loops 52 and 52*a* are formed. Apertures 44, 44*a*, 46, and 46*a* are arranged such that engaging elements 34 and 34*a* intersect one another to enclose an article to be monitored there between. In one preferred embodiment, engaging elements 34 and 34*a* intersect one another at substantially right angles in order to enclose an article there between.

Now referring specifically to FIGS. 13 to 18, an alternate preferred embodiment is illustrated wherein a holder 90 maintains engaging elements 34 and 34*a* adjustably therein. A marker 32 is maintained within the body 20. In a preferred embodiment, holder 90 has a first portion 92 to receive engaging element 34 and a second portion 94 to receive engaging element 34*a*. In the illustrated preferred embodiment, first portion 92 and second portion 94 are hollow passageways that allow the engaging elements 34 and 34*a* to travel there through. But it is to be understood that alternate methods of maintaining engaging elements 34 and 34*a*, such as resilient clips or other devices known in the art, may be substituted therefor. Although in the illustrated preferred embodiment the holder 90 provides substantially perpendicular crossing of the engaging elements 34 and 34*a*, it is to be understood that a wide range of alternate angles, and even parallel alignment, are possible without departing from the essence of the invention.

The preferred embodiment illustrated in FIGS. 11 to 18 can be provided to an end user with engaging elements 34 and 34*a* partially placed within first 44 and second 46 apertures, respectively. The end use places an article to be monitored within the engaging elements 34 and 34*a* and can pull the first ends 36 and 36*a* to firmly secure the engaging elements 34 and 34*a* around the object. These steps are illustrated more particularly in FIGS. 16 through 18. In one preferred embodiment where a holder 90 is used, when an article is engaged by the tag body 90 and engaging elements 34 and 34*a*, holder 90 will be substantially located on a distal and opposing side in relation to tag body 90.

While the above description contains many specificities, these should not be construed as limitations on the scope of the invention, but rather as an exemplification of preferred embodiments thereof. Many other variations are possible without departing from the essential spirit of the preferred embodiments of this invention. Accordingly, the scope of the invention should be determined not by the preferred embodiments illustrated, but by the claims and their legal equivalents.

What is claimed is:

1. A theft deterrent tag attachable to an object to be monitored, comprising:

a tag body;

an engaging element having a first end that is free and is passed through an article to be monitored, and is inserted into a second aperture of the tab body, with a second end of the engaging element inserted through a first aperture of the tab body and anchored and maintained within a first chamber of the tag body, and a middle region there between, forming a first loop;

an attaching mechanism located within the tag body proximal to the second aperture for receiving and maintaining the first end of the engaging element;

the attachment mechanism includes:

a first fastening member that is comprised of a first protrusion that extends from a first distal region of the first fastening member, a first barrier that is substantially rectangular with a side defining a first forward region that is substantially concave to allow passage of the first end there through, with the first protrusion functioning as a stand that pivots along a reciprocating path within a cavity of a first retaining member of the tag body for enabling the first fastening member to move to one of an open and closed positions to substantially open and close a first path, with the first path extending inwardly from second aperture that is defined by a pair of parallel walls extending from a second inner surface and enclosed by first inner surface and second inner surface;

a biasing member that continuously biases the first fastening member towards a normally closed position to substantially close off the first path, the biasing member is located on a side of the first barrier that is opposite side of the first path;

the first end of the engaging element inserted through the first path moves the first fastening member to substantially open the first path to enable continuous insertion of the engaging element, while simultaneously, the biasing member continuously biases the first fastening member back towards the normally closed position against a first edge to substantially close the first path to frictionally prevent an extraction of the engaging element, without crimping;

the first loop formed by the engaging element can be adjusted upon further insertion of the engaging element into the second aperture, past the biasing member, and into a second path, with the first end traveling through the second path and out of the tag body via a third aperture, located distal to second aperture;

whereby, an article is maintained within the first loop.

2. The tag of claim 1, wherein the attaching mechanism further comprises:

the first fastening member movably maintained within the tag body;

the first path extending from the second aperture to the first fastening member and leading said first end of the engaging element to the first fastening member;

the biasing element propelling the first fastening member towards the first path;

the first fastening member moving towards the biasing element upon insertion of the first end;

the first fastening member engaging the first end and maintaining the engaging element within the tag body in an adjustable manner, yet preventing the withdrawal of the engaging element.

3. The tag of claim 2, wherein the first fastening member is propelled toward the first path by the biasing member such that the engaging element is maintained between a wall defining the first path and the first fastening member.

4. The tag of claim 3, wherein a first forward region is defined on the first fastening member and the engaging element is maintained between the first forward region and an edge of the wall defining the first path to prevent the withdrawal thereof, but allow further insertion.

5. The tag of claim 4, wherein:

the first retaining member receiving the protrusion extending from the first fastening member, wherein the protrusion is distal to the first forward region;

an opening of predetermined size defined in the first retaining member, whereby the fastening member moves between the opening in order to allow insertion of the first end and to maintain the engaging element within the tag body.

6. The tag of claim 1, wherein the attaching mechanism further comprises:

the first fastening member movably maintained within the tag body;

a second fastening member movably maintained within the tag body and positioned to oppose the first fastening member;

the second fastening member comprising:

a second protrusion that extends from a second distal region of the second fastening member, a second barrier that is substantially rectangular with a side defining a second forward region that is substantially concave to allow passage of the first end there through, with the second protrusion functioning as a stand that pivots along a reciprocating path within a cavity of a second retaining member of the tag body for enabling the second fastening member to move to one of an open and closed positions to substantially open and close a first path;

the first path extending from the second aperture to the first and second fastening members and guiding said first end of the engaging element to the first and second fastening members;

the biasing element propelling the first and second fastening members towards the first path to prevent the withdrawal of the engaging element in a direction opposite to the path of insertion, but allowing further insertion of the engaging element by forcing the first and second fastening members towards the biasing element.

7. The tag of claim 6, wherein the first fastening member has the first forward region and the second fastening member has the second forward region such that the first and second forward regions are in proximal relations and receive and maintain the engaging element there between.

8. The tag of claim 7, wherein the tag body further comprises:

the first retaining member receiving the first protrusion extending from the first fastening member at a point distal to the first forward region;

a second retaining member receiving the second protrusion extending from the second fastening member at a point distal to the second forward region;

an opening of predetermined size defined in the first retaining member and the second retaining member such that the openings of each retaining member face one another;

whereby, the forward regions of each of the first fastening member and the second fastening member are proximally aligned and move within each respective opening in order to allow insertion of the first end and to maintain the engaging element between the first forward and second forward regions.

9. The tag of claim 2, wherein a plurality of attaching mechanisms are accessibly aligned within the tag body and an EAS marker is enclosed within the tag body.

10. A disposable theft deterrent tag attachable to an object to be monitored, comprising:

a tag body;

an elongated first engaging element having a first end and a distal second end and a first middle region there between;

a first aperture through which the second end is irremovably maintained within said tag body a first attaching mechanism located within the tag body proximal to a second aperture for receiving the first end of the first engaging element;

first attaching mechanism includes a first fastening member that is comprised of a first protrusion that extends from a first distal region of the first fastening member, a first barrier that is substantially rectangular with a side defining a first forward region that is substantially concave to allow passage of the first end there through;

a first biasing member of the first attaching mechanism propelling the first fastening member towards the second aperture to substantially open and close a first path to maintain the first end of the first engaging element within the tag body, with the first path arched and extending inwardly from second aperture that is defined by a pair of curved parallel walls, forming an arched path from the second aperture to a third aperture;

whereby further portions of the first engaging element can be inserted into the tag body, but the first attaching mechanism prevents the withdrawal of the first engaging element in a direction opposite to the direction of the insertion;

a first loop is formed along a first orientation by the first engaging element and can be adjusted upon further insertion of the first engaging element into the second aperture, and extraction thereof from the third aperture;

an elongated second engaging element having a front end and a distal back end nd a second middle region there between;

a fourth aperture through which the back end is irremovably maintained within said tag body;

a second attaching mechanism located within the tag body proximal to a fifth aperture for receiving the front end of the second engaging element;

a second biasing member of the second attaching mechanism propelling a secondary fastening member towards the fifth aperture to substantially open and close a second path to maintain the front end of the second engaging element within the tag body, with the second path substantially straight and extending inwardly from fifth aperture that is defined by a pair of parallel walls, forming a substantially straight path from the fifth aperture to a sixth aperture;

whereby further portions of the second engaging element can be inserted into the tag body, but the second attachment mechanism prevents the withdrawal of the second engaging element in a direction opposite to the direction of the insertion;

a second loop is formed along a second orientation by the second engaging element and can be adjusted upon further insertion of the second engaging element into the fifth aperture, and extraction thereof from sixth aperture;

with the first aperture oriented substantially opposite the second aperture, and the third aperture juxtaposed adjacent the fifth aperture, and a fourth aperture juxtaposed adjacent a sixth aperture;

whereby, an article is maintained within the first and second loops from different orientations.

11. The tag of claim 10, wherein:

the first fastening member movably maintained within the tag body;

the first path extending from the second aperture to the first fastening member and leading said first end of the first engaging element to the first fastening member;

the first biasing element propelling the first fastening member towards the first path;

the first fastening member moving towards the first biasing element upon insertion of the first end;

the first fastening member engaging the first end and maintaining the first engaging element within the tag body in an adjustable manner, yet preventing the withdrawal of the first engaging element;

the secondary fastening member movably maintained within the tag body;

secondary path extending from the fifth aperture to the secondary fastening member and leading said front end of the second engaging element to the secondary fastening member;

the second biasing element propelling the secondary fastening member towards the second path;

the secondary fastening member moving towards the second biasing element upon insertion of the front end;

the secondary fastening member engaging the front end and maintaining the second engaging element within the tag body in an adjustable manner, yet preventing the withdrawal of the second engaging element.

12. The tag of claim 10, wherein a holder adjustably maintains the first and second engaging elements to allow attachment of the tag to the article to be monitored.

13. The tag of claim 10, wherein the first fastening member movably maintained within the tag body;

a second fastening member movably maintained within the tag body and positioned to oppose the first fastening member;

a first path extending from the second aperture to the first and second fastening members and guiding said first end of the first engaging element to the first and second fastening members;

the first biasing element propelling the first and second fastening members towards the first path to prevent the withdrawal of the first engaging element in a direction opposite to the path of insertion, but allowing further insertion of the first engaging element by forcing the first and second fastening members towards the first biasing element and expanding an opening there between;

a third fastening member movably maintained within the tag body;

a fourth fastening member movably maintained within the tag body and positioned to oppose the third fastening member;

a second path extending from the fifth aperture to the third and fourth fastening members and guiding said front end of the second engaging element to the third and fourth fastening members;

the second biasing element propelling the third and fourth fastening members towards the second path to prevent the withdrawal of the second engaging element in a direction opposite to the path of insertion, but allowing further insertion of the second engaging element by forcing the third and fourth fastening members towards the second biasing element and expanding an opening there between.

14. The tag of claim 13, wherein the first fastening member has a first forward region and the second fastening member has a second forward region such that the first and second forward regions are in proximal relations and receive and maintain the first engaging element there between; and the third fastening member has a third forward region and the fourth fastening member has a fourth forward region such that the third and fourth forward regions are in proximal relations and receive and maintain the second engaging element there between.

15. The tag of claim 14, the tag body further comprising:

a first retaining member receiving a first protrusion extending from the first fastening member at a point distal to the first forward region;

a second retaining member receiving a second protrusion extending from the second fastening member at a point distal to the second forward region;

an opening of predetermined size defined in the first retaining member 62/*a* and the second retaining member such that the openings of each retaining member face one another;

the forward regions of each of the first fastening member and the second fastening member are proximally aligned and move within each respective opening in order to allow insertion of the first end and to maintain the first engaging element between the first forward and second forward regions;

a third retaining member receiving a third protrusion extending from the third fastening member at a point distal to the third forward region;

a fourth retaining member receiving a fourth protrusion extending from the fourth fastening member at a point distal to the fourth forward region;

a second pair of openings of predetermined size defined in the third retaining member and the fourth retaining member such that the openings of each of the third and fourth retaining members face one another;

the forward regions of each of the third fastening member and the fourth fastening member are proximally aligned and move within each respective opening in order to allow insertion of the front end and to maintain the second engaging element between the third forward and fourth forward regions.

* * * * *